US008794145B2

(12) United States Patent
Weber

(10) Patent No.: US 8,794,145 B2
(45) Date of Patent: Aug. 5, 2014

(54) FILM TRANSFER DEVICE

(75) Inventor: Alexander Weber, Weinheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 329 days.

(21) Appl. No.: 13/099,732

(22) Filed: May 3, 2011

(65) Prior Publication Data

US 2011/0277650 A1 Nov. 17, 2011

(30) Foreign Application Priority Data

May 11, 2010 (DE) ..... 10 2010 020 250

(51) Int. Cl.
*B41F 16/00* (2006.01)
*B41F 19/00* (2006.01)

(52) U.S. Cl.
CPC ..... *B41F 16/00* (2013.01); *B41F 19/004* (2013.01)
USPC ..... 101/401.1; 101/141; 156/384

(58) Field of Classification Search
None
See application file for complete search history.

(56) References Cited

U.S. PATENT DOCUMENTS

| | | | | |
|---|---|---|---|---|
| 6,334,248 | B1 | 1/2002 | Gallagher | |
| 6,491,780 | B2 | 12/2002 | Gallagher | |
| 7,555,809 | B2 | 7/2009 | Liu | |
| 8,100,160 | B2 | 1/2012 | Franzen et al. | |
| 2001/0047582 | A1 | 12/2001 | Gallagher | |
| 2007/0163455 | A1 | 7/2007 | Eitel et al. | |
| 2008/0022871 | A1 * | 1/2008 | Weber et al. | 101/217 |
| 2008/0271836 | A1 | 11/2008 | Richter et al. | |
| 2008/0277067 | A1 | 11/2008 | Weber | |
| 2008/0295969 | A1 | 12/2008 | Ohsawa | |
| 2009/0294038 | A1 | 12/2009 | Jurkewitz et al. | |
| 2010/0147168 | A1 | 6/2010 | Puschel et al. | |

FOREIGN PATENT DOCUMENTS

| | | | |
|---|---|---|---|
| CN | 1942319 | A | 4/2007 |
| CN | 101301182 | A | 11/2008 |
| CN | 101590717 | A | 12/2009 |
| DE | 10 2005 027 815 | A1 | 12/2006 |
| DE | 102008018753 | A1 | 11/2008 |
| DE | 10 2009 020 106 | A1 | 12/2009 |
| EP | 0 932 501 | B1 | 7/2002 |
| EP | 1 997 631 | A2 | 12/2008 |
| EP | 2004408 | B1 | 9/2009 |
| EP | 1737659 | B1 | 11/2009 |
| WO | 2008/084191 | A1 | 7/2008 |

OTHER PUBLICATIONS

German Patent and Trademark Office Search Report, Dated December 8, 2010.

* cited by examiner

*Primary Examiner* — Joshua D Zimmerman
(74) *Attorney, Agent, or Firm* — Laurence A. Greenberg; Werner H. Stemer; Ralph E. Locher

(57) ABSTRACT

A film transfer device guides a transfer film at least partly around a transfer cylinder having a channel. As a result of entrainment of the transfer film by an edge region of the channel during indexing, considerable impairment to web tension occurs, requiring an indexing speed to be reduced so as not to cause damage to the film. In order to increase an indexing frequency, in one region, i.e. more precisely in an edge region of the channel of the transfer cylinder, a coating is provided having such a nature that it at least reduces an adhesion of a rear side of the transfer film to the edge region of the channel, i.e. to the transfer cylinder in this case. In this way, the film slides better off the edge region of the channel and a higher indexing speed can be achieved.

22 Claims, 3 Drawing Sheets

FILM TRANSFER DEVICE

CROSS-REFERENCE TO RELATED APPLICATION

This application claims the priority, under 35 U.S.C. §119, of German Patent Application DE 10 2010 020 250.9, filed May 11, 2010; the prior application is herewith incorporated by reference in its entirety.

BACKGROUND OF THE INVENTION

Field of the Invention

The present invention relates to a film transfer device including an applicator for applying an adhesive to at least some regions of a printing material led through the applicator, and a transfer unit disposed downstream of the applicator and having a transfer nip for transferring a transfer layer from a carrier film, which together form a transfer film, to at least some regions of the printing material. The transfer nip is formed by a transfer cylinder and an impression cylinder, the transfer film is led at least partly around the transfer cylinder and the transfer cylinder has a channel.

Film transfer devices of the generic type are used in finishing printed products, for example in order to produce gloss effects. Such machines can be subdivided into hot film embossing machines and cold film embossing machines. In the latter, the transfer layer is transferred to flat material, i.e. to a printing material such as a sheet, only under pressure but not additionally under the action of heat. As a rule, in the case of cold film transfer devices, i.e. cold film embossing equipment having a printing unit which is disposed upstream of the transfer device, adhesive is printed on, so that a printed image made of adhesive remains on the sheet and, within a film transfer unit, is able to pull a corresponding transfer layer off the transfer film being used, so that the transfer layer adheres to some regions of the sheet. In that case, the transfer layer can be partially transferred in the transfer nip under the action of pressure, substantially to the regions to which adhesive has been applied.

The problem with that film transfer technology is that the transfer film has to be moved at the same speed as the printing material during the transfer and that, as a rule, only small regions on the printing material are intended to be covered with the transfer layer. In particular, a transfer cylinder involved in the transfer nip frequently has a so-called channel, in which a printing blanket can be fixed. In the region of the channel, no transfer from the transfer layer through the use of pressure can be carried out. Therefore, the intention is always as far as possible to control the situation in such a way that the printing material dips into the transfer nip between the transfer cylinder and an impression cylinder when the channel cannot be in the region of the printing material. Other regions, in which the transfer film is transported unused through the transfer nip, are regions in which no transfer layer is intended to be transferred to the printing material.

For the purpose of better utilization of the transfer film and to reduce consumable materials, provision is made, for example according to European Patent EP 932 501 B1, corresponding to U.S. Pat. Nos. 6,334,248 and 6,491,780, to move the transfer film over a pair of dancer rolls, which are moved cyclically at the same indexing rate as the channel of the transfer cylinder, so that the transfer film is braked to a speed of zero, for example, in the region of the channel. For that purpose, the two dancer rolls are coupled to each other in such a way that transfer film webs, coming from a supply roll which continues to move, are stored by a first leading dancer and simultaneously released to a take-up roll by a second, trailing dancer. In that way, a certain constancy of the web tension in the region of the supply and take-up roll can be ensured. For that purpose, in order to save transfer film, both dancers are moved in a coupled manner in a braking direction. The film can, in particular, also be pulled back out of the transfer nip.

In such devices, with dancers running in the same direction, there is a problem when the transfer cylinder is enclosed by the transfer film and has rotated to such an extent that the transfer film is already able to dip into the channel before the transfer nip, while the transfer film after the transfer nip is still set completely against the transfer cylinder and wraps around the latter. A dancer roll which is disposed after the transfer nip sees nothing of the channel already acting on the film, as a result of the transfer cylinder being set against the impression cylinder. However, a dancer roll which is provided before the transfer nip already "notices" the channel that is present. The leading and the trailing dancer roll are substantially decoupled from each other by the transfer nip. While the web tension remains constant in the region of the trailing dancer roll, it is already decreasing on the side of the leading dancer roll.

Similar effects also occur when the channel is already set with its trailing edge against the impression cylinder.

Whenever the leading and the trailing dancer roll are decoupled from each other, different web tensions therefore occur on the two sides. In addition, a general dip in the web tension occurs on the two sides when the channel is in the region of the transfer nip.

In order to take control of the problem of changing web tension, it has been proposed in German Published Patent Application DE 10 2009 020 106 A1, corresponding to U.S. Patent Application Publication No. US 2009/0294038 A1, to decouple the dancer shafts from each other and to move them asynchronously in relation to each other, in order to compensate for the different web tension changes before and after the channel in that way.

However, it still remains a problem that at least brief changes in the position and in the tension of the film in the channel itself occur. As a result, in particular when the film is intended to be pulled back counter to the feed direction of the sheet during the indexing, the speed with which the film can be transferred to a printed sheet is considerably restricted. That therefore results, amongst other things, in that, in particular as the film is pulled back, the latter is laid at least briefly around the edge region of the channel and can thus be carried along by the channel. Depending on the direction of movement of the film, that occurs on all of the edge regions of the cylinder channel and also on the surfaces of the cylinder channel covering. As a result of that entrainment of the transfer film by the edge region of the channel, considerable impairment of the web tension itself occurs. In order to still ensure proper functioning of the film transfer, the speed of the channel, i.e. the rotational speed of the impression cylinder and of the blanket cylinder, must therefore be reduced in order not to cause any damage to the film.

SUMMARY OF THE INVENTION

It is accordingly an object of the invention to provide a film transfer device, which overcomes the hereinafore-mentioned disadvantages of the heretofore-known devices of this general type and with which a higher indexing speed can be achieved.

With the foregoing and other objects in view there is provided, in accordance with the invention, a film transfer device, comprising an applicator for applying an adhesive to at least some regions of a printing material led through the applicator, and a transfer unit disposed downstream of the applicator. The transfer unit has a transfer cylinder and an impression cylinder. The transfer cylinder has a channel and the transfer cylinder guides a transfer film, having a transfer layer and a carrier film, at least partly around the transfer cylinder. The transfer cylinder and the impression cylinder form a transfer nip for transferring the transfer layer of the transfer film to at least some regions of the printing material. A coating is disposed in the region or vicinity of the channel for at least reducing adhesion of a rear side of the transfer film to the transfer cylinder.

Therefore, in the film transfer device according to the invention, in one region, i.e. more precisely in an edge region of the channel of the transfer cylinder, a coating is provided which is of such a nature that it at least reduces the adhesion of the rear side of the transfer film to this edge region of the channel, i.e. to the transfer cylinder in this case. In this way, the film slides better off the edge region of the channel and a higher indexing speed can be achieved, since the engagement of the edge region of the channel in the film is reduced. The effects on the tension of the transfer film are reduced to such an extent as a result that, even given relatively high indexing speeds, no damage to the transfer film itself is to be expected.

In accordance with another feature of the film transfer device of the invention, provision is made for this coating to be provided both on the edges of the channel and also additionally or alternatively on the top side of a channel covering of the channel. In particular, it can always be provided only in the edge regions of the channel covering and of the channel. For this purpose, the coating is provided axially with respect to the axis of the transfer cylinder, particularly preferably over the entire width or at least in the regions in which the transfer film makes contact with the transfer cylinder.

In accordance with a further feature of the invention, the coating can, in particular, involve a strip which can also subsequently be adhesively bonded to the edge and/or to the channel covering.

In accordance with an added feature of the invention, possible adhesive strips which are adhesively bonded to the channel covering and/or to the edge of the channel can, in particular, be crêpe paper or a non-stick paper. In addition, a surface of the printing blanket of the transfer cylinder itself can be involved. The transfer cylinder should, in particular, have a substantially smooth surface and only in the regions of the channel have a surface structure differing therefrom, which has an appropriate coating in order to reduce the friction with the transfer film. The materials of the non-stick paper or the surface of the printing blanket can, for example, be silicone or PTFE.

In accordance with an additional feature of the invention, since, as a result of such coatings of the printing blanket, it is possible for effects on the film transfer itself to occur but which are undesired, since they can be detected in the printed image, provision is particularly advantageously made for the peripheral direction, i.e. the width, of this coating or the strip, which is adhesively bonded to the transfer cylinder or applied in another way, to be restricted substantially to a region of the edge of the channel which cannot come into contact with a region of the printing material that should be coated or printed, is intended to be coated or printed or has been coated or printed. In this way, the effect of this coating or this strip on the printing material cannot be detected in a resulting printed image.

In accordance with a concomitant feature of the invention, the strip according to the invention can advantageously be formed as an adhesive strip or other holding possibilities, such as magnetic or electrostatic methods, are also conceivable in this case.

Other features which are considered as characteristic for the invention are set forth in the appended claims.

Although the invention is illustrated and described herein as embodied in a film transfer device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
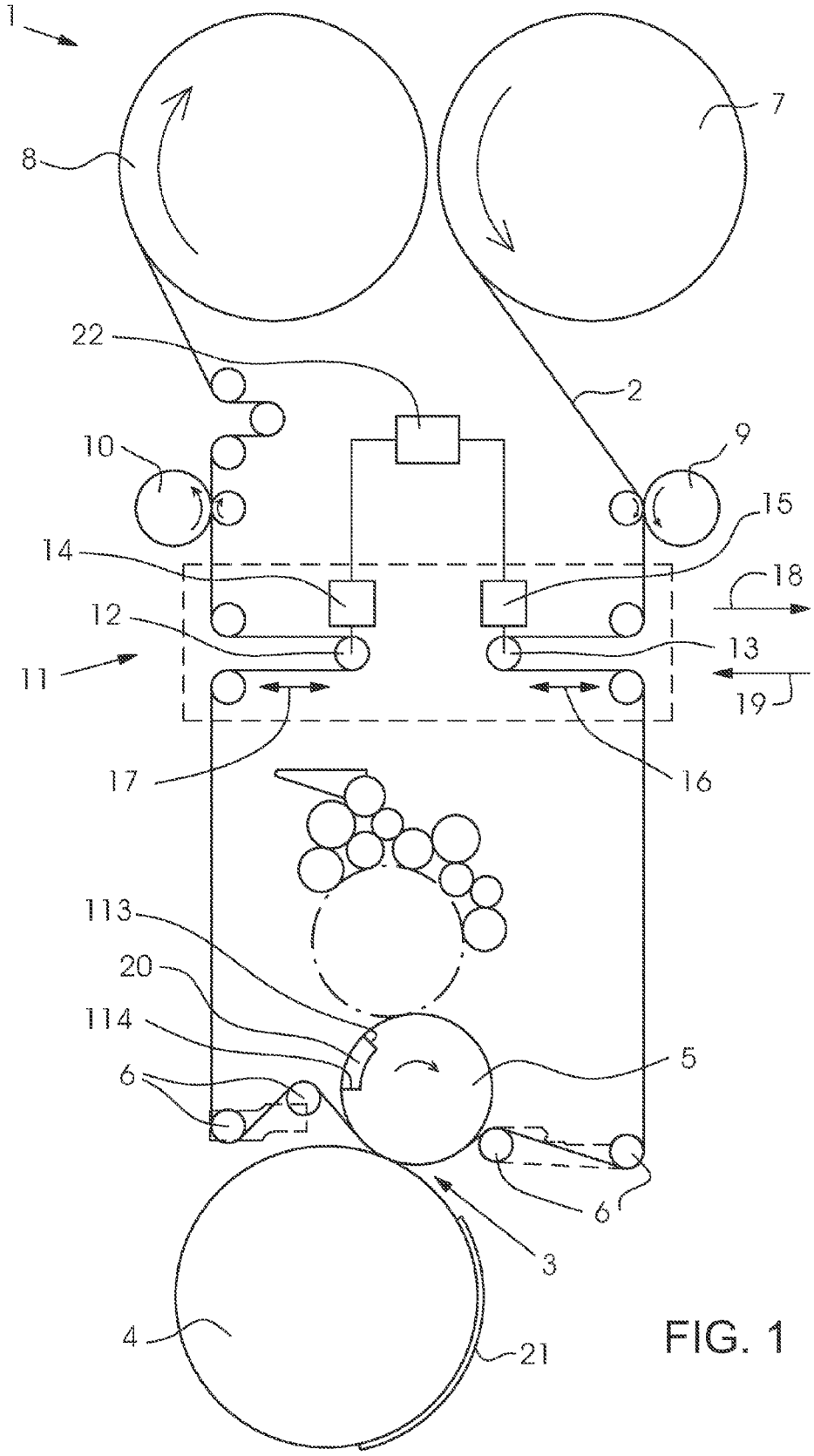
FIG. 1 is a diagrammatic, vertical-sectional view showing a structure of a film transfer unit with indexing.

Referring now in detail to the figures of the drawings, which show an exemplary embodiment of the invention, from which further inventive features can also be gathered but to which the invention is not restricted, and first, particularly, to FIG. 1 thereof, there is seen a film transfer unit 1 in which a transfer film 2 is led through a transfer nip 3.

The transfer nip 3 is formed by a transfer cylinder 5 and an impression cylinder 4. The transfer film 2 is unwound from a supply roll 7 and pulled in the direction of the transfer nip 3 by a leading feed device 9. The supply roll 7 is located on a non-illustrated friction shaft and is driven at a speed which is lower than the speed of printing material 21. A drive for the supply roll 7 is provided through the friction shaft. The transfer film 2 is pulled off the supply roll 7 by the leading feed device 9, while rollers of the leading feed device 9 are driven at a higher speed than the friction shaft of the supply roll 7. However, the leading feed device 9 must always be operated at a lower speed than the speed of the printing material 21.

The unwound transfer film 2 is led over a leading dancer 13 of an indexing module 11 and over further deflection rollers 6 through the transfer nip 3 in such a way that it enters into a wrap angle $\alpha$ with the transfer cylinder 5. After the transfer nip 3, the transfer film 2 is deflected further over deflection rollers 6 and fed to a trailing dancer 12, which deflects the transfer film 2 and feeds it to a trailing feed device 10, which is faster than the leading feed device 9. The film 2 is deflected onto a take-up roll 8 by the trailing feed device 10. The take-up roll 8 is also mounted on a friction shaft, which is driven more quickly than the trailing feed device. At least the friction shaft is driven in such a way that the peripheral speed of the take-up roll 8 is higher than the speed of the trailing feed device 10. In this way, there is slippage between the friction shaft and the actual take-up roll 8. The same is true in the same way of the supply roll 7.

The printing material 21 is led over the impression cylinder 4 through the transfer nip 3 together with the transfer film 2. During the transfer of a non-illustrated transfer layer, the transfer film 2 and the printing material 21 are moving at the same speed.

The transfer cylinder 5 has a non-illustrated printing blanket which is clamped-in through a channel 20. The channel 20 is also able to accommodate possible grippers on the side of the impression cylinder 4.

When a leading edge 113 of the channel 20 comes into the transfer nip 3, a web tension between the dancer 13 and the transfer nip 3 collapses. During the transfer of the transfer layer to the printing material 21, the sum of the speed of the leading feed device 9 and of the leading dancer 13 gives the speed of the printing material 21. For this purpose, the dancer 13 is moved in an acceleration direction 18 along a path which is identified by a double arrow 16. As a result of the leading edge 113 of the channel 20 making contact with the impression cylinder 4, the leading dancer 13 is decoupled from the trailing dancer 12. In order to now compensate for the diminishing web tension, provision is made for the leading dancer 13 to be driven through a motor 15 in such a way that it is initially accelerated highly in a braking direction 19. In this way, a constant web tension is achieved in this region. For this purpose, a control apparatus 22 acts in an appropriate way on the motor 15 of the leading dancer 13. Once the channel 20 is completely in the region of the transfer nip 3, then the dancer 13 is moved in the braking direction 19 with a lower acceleration, so that the transfer film 2 comes to a standstill and is pulled back.

If the channel 20 is "seen" for the first time by the dancer 12, then the trailing dancer 12 is initially accelerated in the braking direction 19 with a lower acceleration in order to compensate for this dip and subsequently accelerated with a higher speed, so that standstill of the transfer film 2 can be achieved. For this purpose, the control apparatus 22 is also connected to a motor 14 of the trailing dancer 12.

Figure 2:
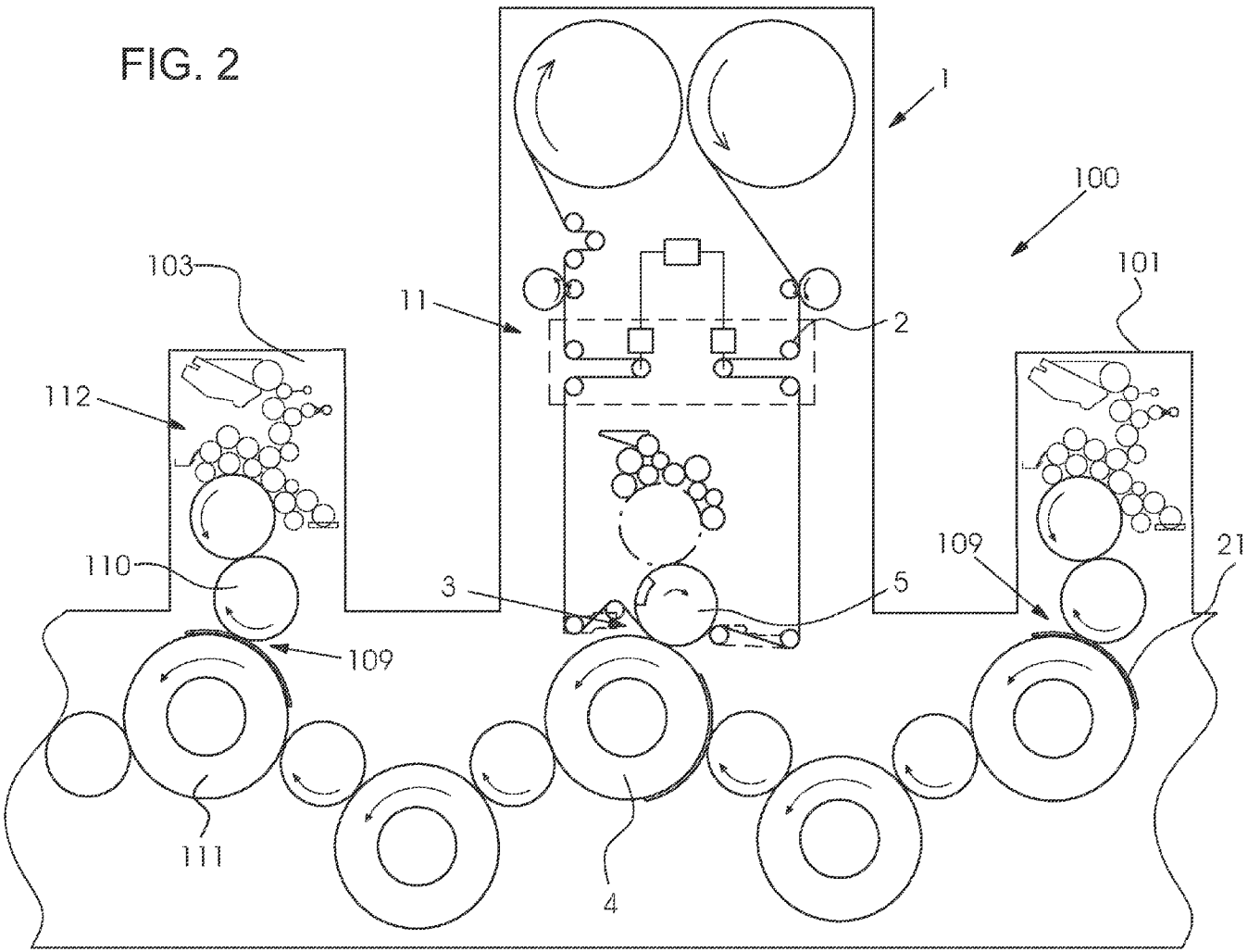
FIG. 2 is a reduced, fragmentary, vertical-sectional view of a film transfer device having a corresponding film transfer unit.

FIG. 2 shows a portion of a film transfer device 100. Such a film transfer device 100 can be constructed within a printing press. A sheet 21 is transported through a press nip 109 by an applicator 101, which is a conventional printing unit of a printing press. In this press nip 109, the printing material 21 has adhesive applied partially to it. The sheet 21 is then transported further through the film transfer unit 1. As described, the sheet 21 is led through the transfer nip 3, in which it picks up the transfer layer of the transfer film 2 from the transfer film 2 in the regions in which it itself has had adhesive applied.

The sheet 21, which is treated in this way, can then be transported further through the printing press, i.e. through the film transfer device, so that it is moved to a further, following printing unit 103, which once more has a press nip 109 that is formed by a blanket cylinder 110 and an impression cylinder 111. The printing unit 103 additionally has an inking unit 112. In the printing unit 103, the sheet 21 to which a transfer layer has been applied can then be overprinted conventionally.

Figure 3:
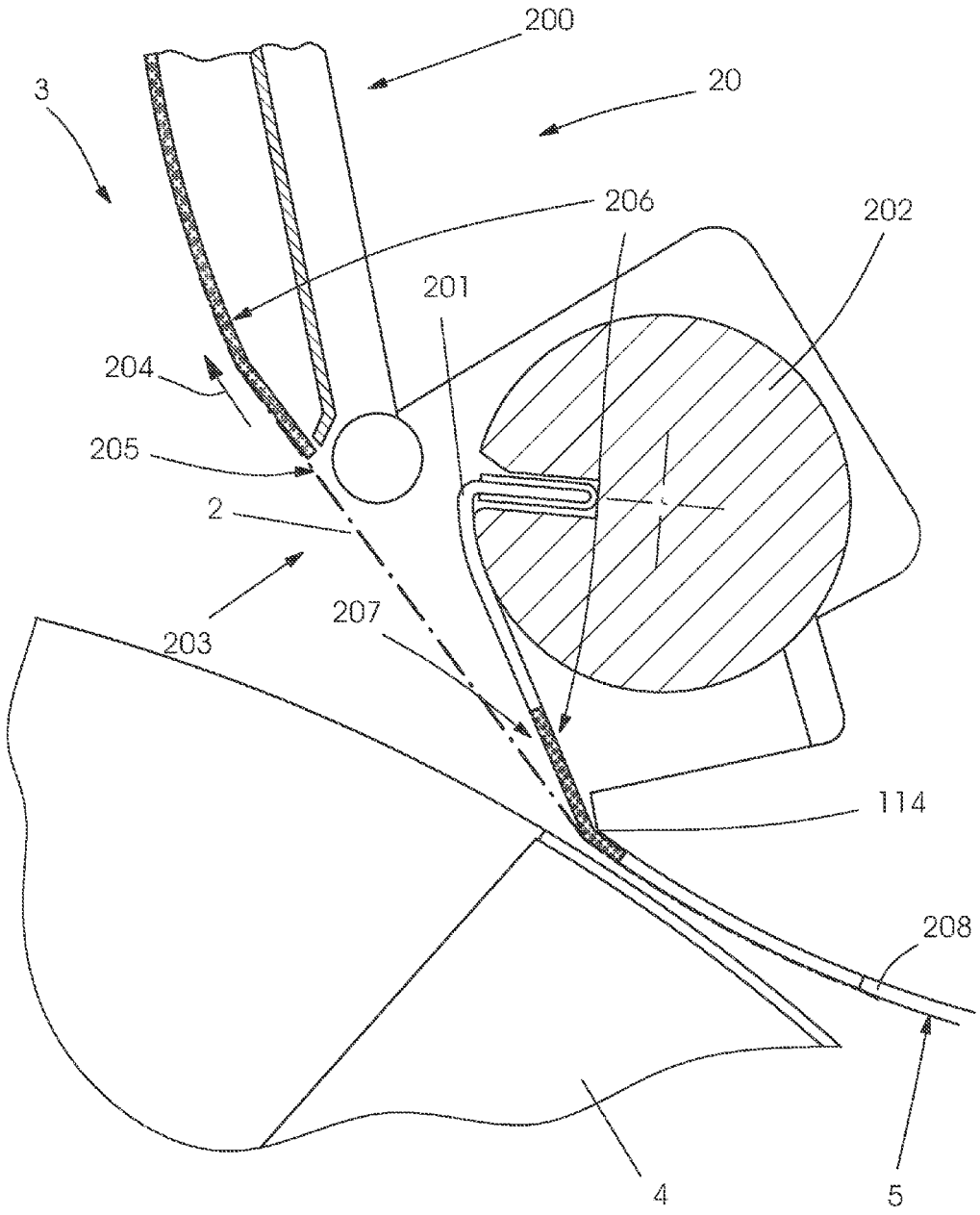
FIG. 3 is an enlarged, fragmentary, cross-sectional view of an edge region of a transfer cylinder channel.

FIG. 3 shows a portion of a transfer cylinder 5. This portion shows a trailing edge 114 of the channel 20 of the transfer cylinder 5. The transfer cylinder 5 shown herein further has a channel covering 200. This channel covering is conventionally provided in transfer cylinders 5 and also in conventional blanket cylinders 110 in printing units 103 or applicators 101. In this way, the area of intervention for operators is reduced, so that in this case it is possible for less injury to people to occur and, moreover, the fluctuations of the transfer film 2 are also already reduced by this channel covering 200.

The transfer cylinder 5 in this case has a covering, lining or clothing with a printing blanket, i.e. a rubber blanket 201. In this case, this is, in particular, an especially smooth rubber blanket, for example a so-called Irioblanket™. This printing blanket 201 is held in the channel 20 both in the region of the leading edge 113 and also the trailing edge 114, by respective clamping devices 202.

During indexing of the transfer film 2, the latter dips at least into a sub-region 203 of the channel 20 and can then be laid around the trailing edge 114 in this case, in particular as the transfer film 2 is pulled back. If the transfer film 2 is moved in a feed direction in the direction of an arrow 204 relative to the transfer cylinder, counter to the reverse pull, then it is possible for the transfer film 2 to be laid around an edge 205 of the channel covering 200 in a corresponding way. The leading region of the channel 20 in the region of the leading edge 113 is constructed symmetrically in relation to the trailing region illustrated herein and thus, as the transfer film 2 is fed in the direction of the arrow 204, wrapping around the leading edge 113 of the channel 20 occurs in a corresponding way in this case.

As is illustrated herein, both the channel covering 200 and the trailing edge 114 and, likewise, the leading edge 113 not shown herein, have a strip 206 applied symmetrically thereto. The channel covering 200 is covered completely by the strip 206, while the trailing edge 114 and, symmetrically thereto, the leading edge 113 have the strip 206 applied to them in such a way that the printing blanket 201 is covered by the strip 206 only in a sub-region 207. In this case, the strip 206 should end shortly after the respective trailing edge 114 and leading edge 113, so that in this case a strip 206 is no longer provided in the region of a print start 208. In this case, print start 208 means the region of the transfer cylinder 5 in which a transfer layer can be transferred from the transfer film 2 to the sheet 21.

In the example presented herein, the strip 206 is crêpe tape, which has such a surface nature that it reduces the friction between the trailing side of the transfer film 2 and the printing blanket 201 and, respectively, the channel covering 200, so that it is not possible for adhesion of the transfer film 2 to the trailing edge 114 of the channel 20, to the leading edge 113 of the channel 20 or in a region or edge 205 of the channel covering, to occur. Such adhesion limits the indexing speed of the film transfer device and the film transfer unit 1. The strip 206 can, in particular, also be incorporated into the printing blanket 201 but can preferably be adhesively bonded on because of the ability to be retrofitted. As an alternative to crêpe tape, it is also possible to use a strip which is adapted from PTFE, silicone or a non-stick paper, as is usual, for example, in the cooking oven field. Therefore, the strip 206 can be referred to as a coating or coating element disposed in vicinity of the channel 20, that is at the edges 113, 114, 205.

Through the use of this coating element that can be applied simply, even subsequently, i.e. through the use of the strip 206, it is possible to achieve a considerable increase in the indexing speed of the film transfer unit 1.

The invention claimed is:

1. A film transfer device, comprising:

an applicator for applying an adhesive to at least some regions of a printing material led through said applicator;

a transfer unit disposed downstream of said applicator, said transfer unit having a transfer cylinder and an impression cylinder, said transfer cylinder having a channel and said transfer cylinder guiding a transfer film, having a transfer layer and a carrier film, at least partly around said transfer cylinder;

said transfer cylinder and said impression cylinder forming a transfer nip for transferring the transfer layer of the transfer film to at least some regions of the printing material; and a coating disposed in vicinity of said channel for at least reducing adhesion of a rear side of the transfer film to said transfer cylinder.

2. The film transfer device according to claim 1, wherein said channel has at least one edge on which said coating is provided axially relative to an axis of said transfer cylinder, substantially over a width of the transfer film.

3. The film transfer device according to claim 1, which further comprises a channel covering for covering said channel, said channel covering having a top side on which said coating is provided axially relative to an axis of said transfer cylinder, substantially over a width of the transfer film.

4. The film transfer device according to claim 1, which further comprises:

a channel covering for covering said channel, said channel covering having a top side;

said channel having at least one edge; and said coating being provided on said top side and on said at least one edge axially relative to an axis of said transfer cylinder, substantially over a width of the transfer film.

5. The film transfer device according to claim 2, wherein said coating is provided as a strip on said at least one edge.

6. The film transfer device according to claim 3, wherein said coating is provided as a strip on said channel covering.

7. The film transfer device according to claim 4, wherein said coating is provided as a strip on said at least one edge and on said channel covering.

8. The film transfer device according to claim 5, wherein said strip is selected from the group consisting of a crâpe paper, a non-stick paper and a surface made of silicone or PTFE.

9. The film transfer device according to claim 6, wherein said strip is selected from the group consisting of a crêpe paper, a non-stick paper and a surface made of silicone or PTFE.

10. The film transfer device according to claim 7, wherein said strip is selected from the group consisting of a crêpe paper, a non-stick paper and a surface made of silicone or PTFE.

11. The film transfer device according to claim 2, wherein said coating has a width restricted substantially to a region of said at least one edge of said channel not coming into contact with a region of the printing material having been coated in a preceding unit or in said transfer unit.

12. The film transfer device according to claim 4, wherein said coating has a width restricted substantially to a region of said at least one edge of said channel not coming into contact with a region of the printing material having been coated in a preceding unit or in said transfer unit.

13. The film transfer device according to claim 5, wherein said strip has a width restricted substantially to a region of said at least one edge of said channel not coming into contact with a region of the printing material having been coated in a preceding unit or in said transfer unit.

14. The film transfer device according to claim 7, wherein said strip has a width restricted substantially to a region of said at least one edge of said channel not coming into contact with a region of the printing material having been coated in a preceding unit or in said transfer unit.

15. The film transfer device according to claim 11, wherein said transfer cylinder has a cover in the form of a printing blanket or a rubber blanket, and said coating is applied to a surface of said printing blanket or said rubber blanket in vicinity of said at least one channel edge.

16. The film transfer device according to claim 12, wherein said transfer cylinder has a cover in the form of a printing blanket or a rubber blanket, and said coating is applied to a surface of said printing blanket or said rubber blanket in vicinity of said at least one channel edge.

17. The film transfer device according to claim 13, wherein said transfer cylinder has a cover in the form of a printing blanket or a rubber blanket, and said strip is applied to a surface of said printing blanket or said rubber blanket in vicinity of said at least one channel edge.

18. The film transfer device according to claim 14, wherein said transfer cylinder has a cover in the form of a printing blanket or a rubber blanket, and said strip is applied to a surface of said printing blanket or said rubber blanket in vicinity of said at least one channel edge.

19. The film transfer device according to claim 5, wherein said strip is an adhesive strip.

20. The film transfer device according to claim 6, wherein said strip is an adhesive strip.

21. The film transfer device according to claim 7, wherein said strip is an adhesive strip.

22. The film transfer device according to claim 1, wherein said coating is disposed only in vicinity of said channel.

* * * * *